US010500643B2

(12) United States Patent
Huber et al.

(10) Patent No.: US 10,500,643 B2
(45) Date of Patent: Dec. 10, 2019

(54) DIRECT FORMATION OF GOLD NANOPARTICLES USING ULTRASOUND

(71) Applicant: National Technology & Engineering Solutions of Sandia, LLC, Albuquerque, NM (US)

(72) Inventors: Dale L. Huber, Albuquerque, NM (US); John Daniel Watt, Albuquerque, NM (US); Jonathan Chavez, Grovetown, GA (US); Lauren Marie Ammerman, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 298 days.

(21) Appl. No.: 15/484,856

(22) Filed: Apr. 11, 2017

(65) Prior Publication Data

US 2017/0291224 A1 Oct. 12, 2017

Related U.S. Application Data

(60) Provisional application No. 62/321,415, filed on Apr. 12, 2016.

(51) Int. Cl.
*B22F 9/04* (2006.01)
*B22F 1/00* (2006.01)

(52) U.S. Cl.
CPC ..... *B22F 9/04* (2013.01); *B22F 1/0044* (2013.01); *B22F 2301/255* (2013.01)

(58) Field of Classification Search
None
See application file for complete search history.

(56) References Cited

U.S. PATENT DOCUMENTS 3,717,481 A * 2/1973 Short ..... C22B 11/04 106/1.26

OTHER PUBLICATIONS

Li et al., "A facile way for preparing tin nanoparticles from bulk tin via ultrasound dispersion", Jan. 23, 2006, Ultrasonics Sonochemistry 14 (2007), p. 89-92 (Year: 2006).*

(Continued)

*Primary Examiner* — Keith Walker
*Assistant Examiner* — Adil A. Siddiqui
(74) *Attorney, Agent, or Firm* — Kevin W. Bieg

(57) ABSTRACT

The invention provides a green chemistry, aqueous method to synthesize gold nanoparticles directly from bulk gold sources. The method involves the ultrasonication of bulk gold in water in the presence of an alkythiol species and a quaternary ammonium surfactant. An organic bilayer forms on the surface of the gold which renders it susceptible to material ejection from the violent collapse of cavitation bubbles. This ejected material is stabilized in solution by the formation of an organic bilayer and can be easily separated. It can then be subjected to an aqueous digestive ripening step to give a gold nanoparticle ensemble with a well-defined plasmon resonance. This method is applicable to a number of different sources of bulk gold. The method can be applied to an environmentally important problem; the recovery of gold from electronic waste streams. For example, gold nanoparticles can be extracted directly from the surface of SIM cards, with no prior manipulation of the cards necessary.

15 Claims, 6 Drawing Sheets

(56) References Cited

OTHER PUBLICATIONS

Liu et al., Size-Controlled Synthesis of Gold Nanoparticles from Bulk Gold Substrates by Sonoelectrochemical Methods, Sep. 15, 2004, J. Phys. Chem. B 2004, 108, p. 19237-19240 (Year: 2004).*
Dai et al., "Rapid formation of high-quality self-assembled monolayers of dodecanethiol on polycrystalline gold under ultrasonic irradiation", Jan. 22, 2008, Electrochimica Acta 53 (2008), p. 3479-3483 (Year: 2008).*
Prasad et al., "Digestive-Ripening Agents for Gold Nanoparticles: Alternatives to Thiols", 2003, Chem. Mater. 2003, 15, p. 935-942 (Year: 2003).*
Sau et al. "Self-Assembly Patterns Formed upon Solvent Evaporation of Aqueous Cetyltrimethylammonium Bromide-Coated Gold Nanoparticles of Various Shapes", 2005, Langmuir 2005, 21, p. 2923-2929 (Year: 2005).*
Uson et al. "Continuous microfluidic synthesis and functionalization of gold nanorods", Oct. 9, 2015, Chemical Engineering Journal 285, p. 286-292 (Year: 2015).*
Hongal et al. "A Technical Method of Extraction of Gold From E-Waste: A Multi-Sensor Based Method Using Microcontroller", May 2014, IJRET: International Journal of Research in Engineering and Technology, p. 94-97 (Year : 2014).*
Suslick, K. S. et al., "Inside a Collapsing Bubble: Sonoluminescence and the Conditions During Cavitation", Annu. Rev. Phys. Chem., 2008, pp. 659-683, vol. 59.
Suslick, K. S. et al., "Applications of Ultrasound to Materials Chemistry", Annu. Rev. Mater, Sci., 1999, pp. 295-326, vol. 29.
Xu, H. et al., "Sonochemical Synthesis of Nanomaterials", Chem. Soc. Rev., 2013, pp. 2555-2567, vol. 42.
Gadanken, A., "Using Sonochemistry for the Fabrication of Nanomaterials", Ultrasonics Sonochemistry, 2004, pp. 47-55, vol. 11.
Li, Z. et al., "A Facile Way for Preparing Tin Nanoparticles from Bulk Tin Via Ultrasound Dispersion", Ultrasonics Sonochemistry, 2007, pp. 89-92, vol. 14.
Friedman, H. et al., "Micro- and Nano-Spheres of Low Melting Point Metals and Alloys, Formed by Ultrasonic Cavitation", Ultrasonics Sonochemistry, 2013, pp. 432-444, vol. 20.
Han, Z. H. et al., "Synthesis of Low-Melting-Point Metallic Nanoparticles with an Ultrasonic Nanoemulsion Method", Ultrasonics, 2011, pp. 485-488, vol. 51.
Maisonhaute, E. et al., "Surface Acoustic Cavitation Understood Via Nanosecond Electrochemistry. Part III: Shear Stress in Ultrasonic Cleaning", Ultrasonics Sonochemistry, 2002, pp. 297-303, vol. 9.
Pereira, F. et al., "Measurement and Modeling of Propeller Caviation in Uniform Inflow", Journal of Fluids Engineering, 2004, pp. 671-679, vol. 126.
Manikandan, M. et al., "Sonophysical Cost Effective Rapid Indigenous Preparation of Aluminium Particles via Exfoliation of Aluminium Foil", RSC Advances, 2016, pp. 32405-32413, vol. 6.
Verhaagen, B. et al., "Measuring Cavitation and Its Cleaning Effect", Ultrasonics Sonochemistry, 2016, pp. 619-628, vol. 29.
Dai, J. et al., "Rapid Formation of High-Quality Self-Assembled Monolayers of Dodecanethiol on Polycrystalline Gold Under Ultrasonic Irradiation", Electrochimica Acta, 2008, pp. 3479-3483, vol. 53.

* cited by examiner

FIG. 2a
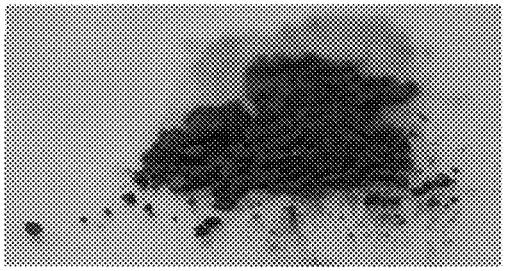
FIG. 2b
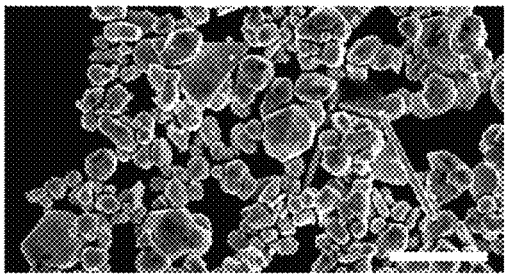
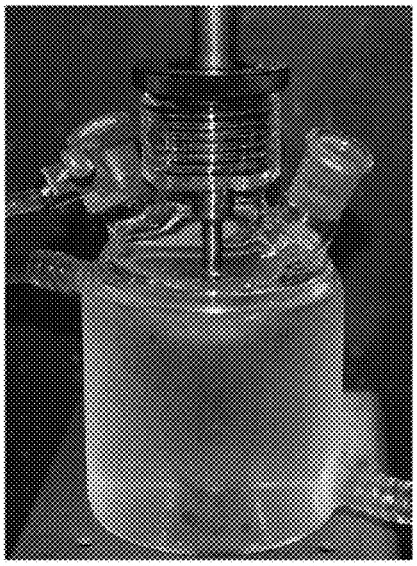
FIG. 2c
FIG. 2d
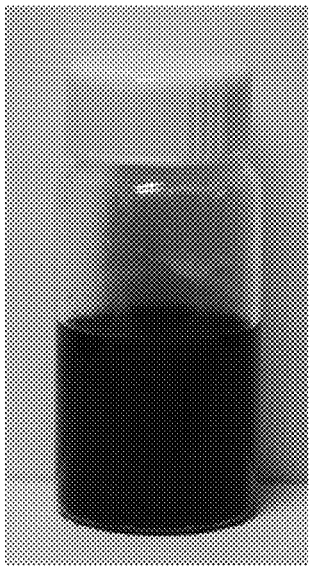
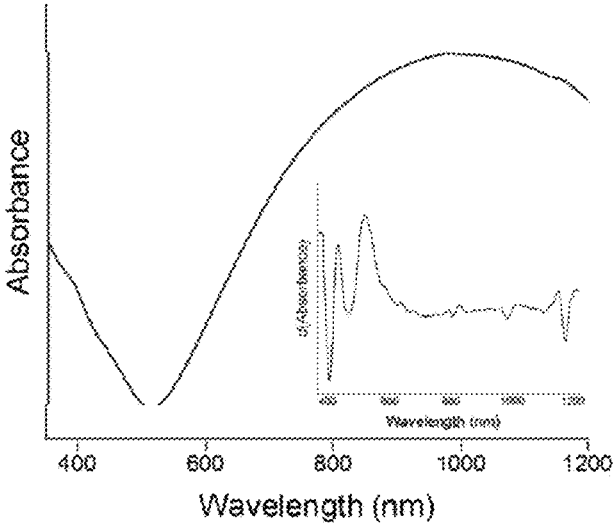
FIG. 2e

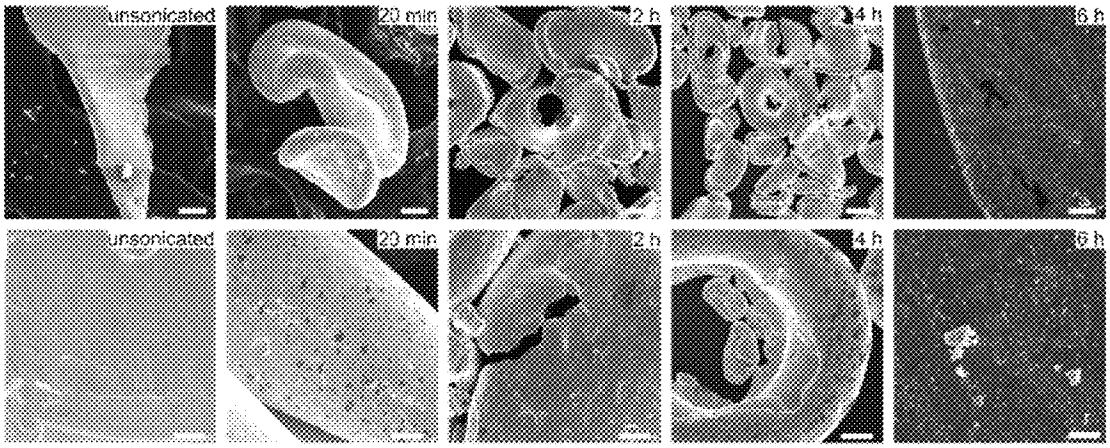
FIG. 5a
FIG. 5b
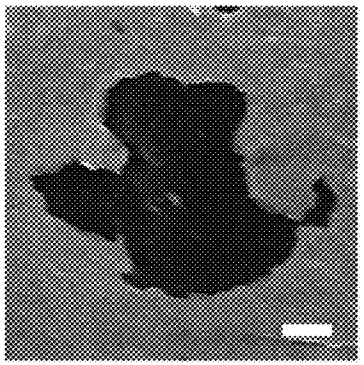
FIG. 5c
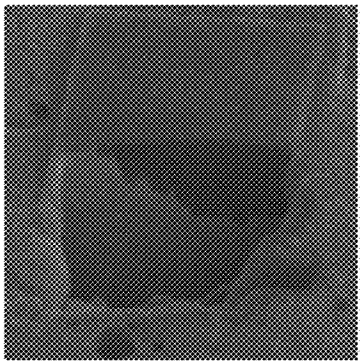
FIG. 5d
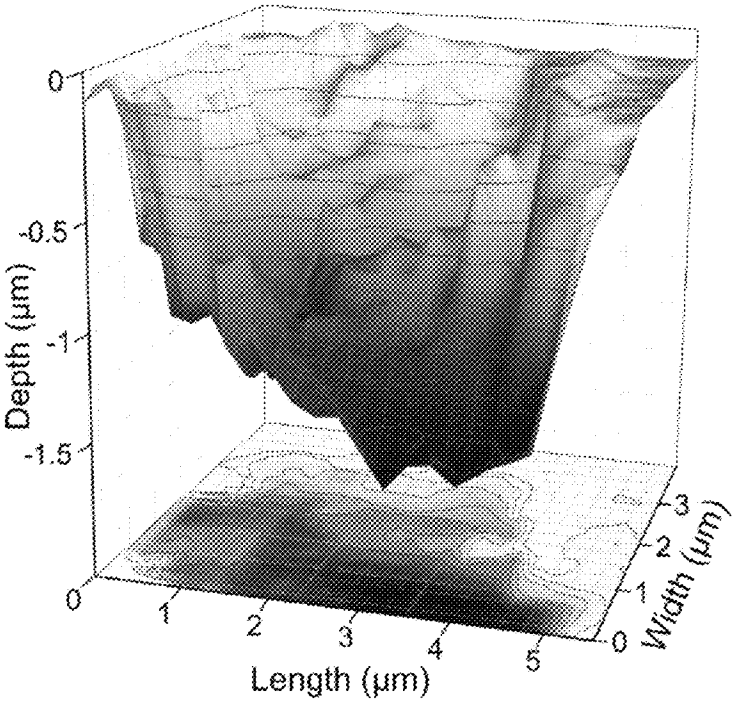
FIG. 5e

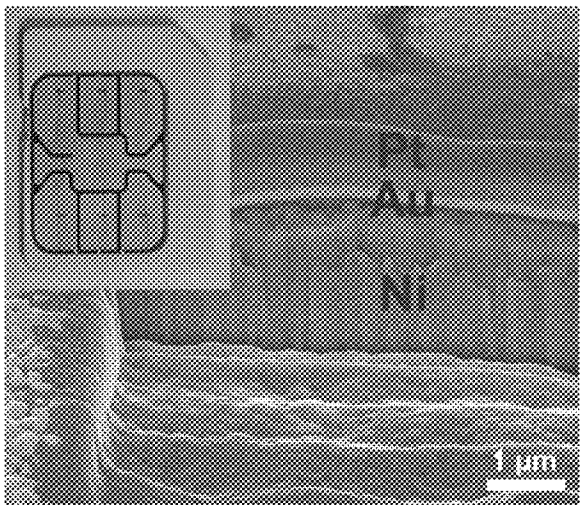
FIG. 6a
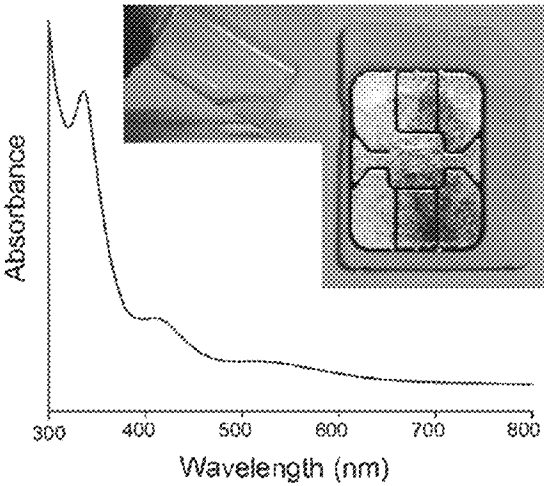
FIG. 6b
FIG. 6c
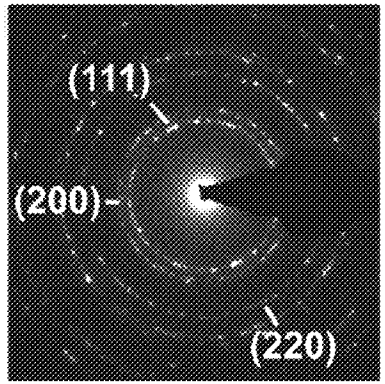
FIG. 6d
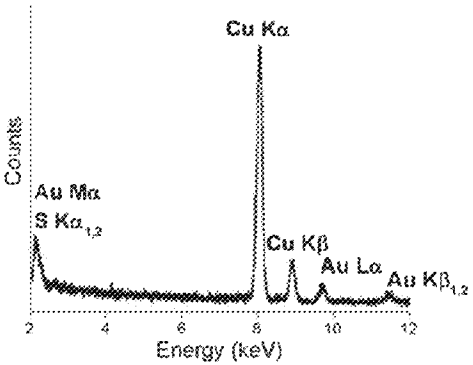
FIG. 6e

DIRECT FORMATION OF GOLD NANOPARTICLES USING ULTRASOUND

CROSS-REFERENCE TO RELATED APPLICATION

This application claims the benefit of U.S. Provisional Application No. 62/321,415, filed Apr. 12, 2016, which is incorporated herein by reference.

STATEMENT OF GOVERNMENT INTEREST

This invention was made with Government support under contract no. DE-AC04-94AL85000 awarded by the U. S. Department of Energy to Sandia Corporation. The Government has certain rights in the invention.

FIELD OF THE INVENTION

The present invention relates to the formation of gold nanoparticles and, in particular, to direct formation of gold nanoparticles from bulk metal sources through the application of ultrasound.

BACKGROUND OF THE INVENTION

Gold nanoparticles have been one of the most extensively studied nanoparticle systems over the past few decades and there are now well established syntheses for a wide range of sizes and morphologies including spheres, nanorods, and nanoplates. See J. Watt et al., *Chem. Mater.* 27, 6442 (2015); S. E. Lohse et al., *Chem. Mater.* 26, 34 (2014); L. Chen et al., *Nano Lett.* 14, 7201 (2014); L. Scarabelli et al., *The Journal of Physical Chemistry Letters* 6, 4270 (2015); K. Park et al., *Chem. Mater.* 25, 555 (2013); and A. M. Henning et al., *Angewandte Chemie-International Edition* 52, 1477 (2013). This high level of research interest is largely due to the possession of well-defined surface plasmon resonances (SPRs) which are sensitive to changes in nanoparticle size, shape and crystallinity. See J. Zheng et al., *Nanoscale* 4, 4073 (2012); K. Park et al., *Journal of Physical Chemistry C* 118, 5918 (2014); V. Juvéet al., *Nano Lett.* 13, 2234 (2013); and H. J. Chen et al., *Chem. Soc. Rev.* 42, 2679 (2013). The ability to fine tune the optical properties means gold nanoparticles show great potential for a number of applications including theranostics, photothermal therapy, and sensor technologies. See J. Qin et al., *Nanoscale* 7, 13991 (2015); A. J. McGrath et al., *ACS Nano* (2015); and Z. Wu et al., *Small* 8, 2028 (2012).

Metallic gold is chemically inert so gold salts are typically used as precursors for nanoparticle synthesis; tetrachloroaurate ($HAuCl_4$) being the most common. Tetrachloroaurate is highly corrosive, with limited exposure known to cause skin and eye damage. It is hygroscopic and requires a dry atmosphere for storage as well as care in handling to ensure uncontrollable hydration does not affect reaction stoichiometry. It's most damaging aspect however, comes from its production, which requires the dissolution of bulk metallic gold in aqua regia; an incredibly harsh acid. Then, in order to form gold nanoparticles tetrachloroaurate is converted back into Au(0) by a reducing agent; usually sodium borohydride ($NaBH_4$). Although widely used for the synthesis of gold nanoparticles, this reaction is inefficient and highly toxic and violates a number of the 12 Principles of Green Chemistry i.e., the reaction has incredibly poor atom economy (only 1 in 12), and generates environmentally harmful side products, as well as typically using a large excess of reducing agent. There are a number of greener approaches that use environmentally friendly reducing agents; however, they still rely on tetrachloroaurate as the gold precursor and display poor atom economy. See R. K. Sharma et al., *J. Chem. Educ.* 89, 1316 (2012); S. K. Das et al., *Green Chemistry* 14, 1322 (2012); and N. N. Dhanasekar et al., *J. Microbiol. Biotechnol.* 25, 1129 (2015).

SUMMARY OF THE INVENTION

The present invention is directed to a method to produce gold nanoparticles directly from bulk metal, eliminating the need for the toxic dissolution and reduction steps. Gold nanoparticle formation occurs when bulk gold is subjected to ultrasonication in water in the presence of a surfactant and an alkylthiol species. Ultrasound drives the formation and implosive collapse of cavitation bubbles which impinge violently on the gold metal surface, liberating nanostructures which are stabilized in solution by an organic bilayer. These can then be isolated and digestively ripened in water to give a nanoparticle solution displaying a well-defined surface plasmon resonance. The method can use a number of different bulk gold sources. The method can be applied to an important environmental problem; the recovery of gold from electronic waste. For example, gold nanostructures can be produced directly from cellular subscriber identity module (SIM) cards with no prior manipulation of the SIM cards required, thereby upcycling a waste stream directly to a high value product.

BRIEF DESCRIPTION OF THE DRAWINGS

The detailed description will refer to the following drawings, wherein like elements are referred to by like numbers.

FIGS. 2*a-e* show the effect of ultrasonication on a bulk gold source in the presence of dodecanethiol and didodecylammounium bromide (DDAB) in water. FIG. 2*a* is a photograph of ultrasonicated bulk gold in the form of a powder. FIG. 2*b* is a scanning electron microscopy (SEM) analysis revealing the powder to consist of hexagonal and plate-like particles. Scale bar=5 μm. FIG. 2*c* shows an ultrasonication reaction setup consisting of a glass cooling jacket and conical shaped reaction vessel. Ultrasonic treatment was carried out by a 6.4 mm diameter Ti sonication tip operating at 18 W and 20 kHz for up to 6 h. FIG. 2*d* is a photograph of the resulting dark blue solution, a color indicative of finely divided gold. FIG. 2*e* is a UV-vis spectrum of the solution, along with differential absorption (inset).

FIG. 3*a* is a TEM of micron sized structures with ill-defined morphologies. FIG. 3*b* is a TEM of gold spheroid and rod-like nanoparticles ranging in size from 5 nm to 100 nm. Selected area electron diffraction (inset) of the nanoparticles could be indexed to the face centered cubic (fcc) crystal structure. FIG. 3*c* is an energy dispersive X-ray spectroscopy (EDX) analysis showing Au as the only metal present in solution. FIG. 3*d* is a high magnification TEM revealing a population of nanoparticles 2.0±0.3 nm in size which can be indexed to fcc gold (inset). FIGS. 3*e* and 3*f* are TEM and scanning transmission electron microscopy (STEM) images of ribbon-like superstructures formed by small gold nanoparticles.

FIGS. 5*a* and 5*b* show SEM analysis at low and high magnification of 0.01 mm thick gold foil that has been subjected to ultrasonication for 0 min, 20 min, 2 h, 4 h, and 6 h. Scale bars show 50 μm and 10 μm, respectively. FIG. 5*c* is a secondary electron SEM image of a typical cavitation pit observed on the surface of 0.01 mm thick gold foil after ultrasonication for 20 min. Scale bar=1 μm. FIG. 5*d* is a SEM image of a slice of a Pt filled cavitation pit formed using focused ion beam milling (FIB). FIG. 5*e* is a 3D schematic representation of a typical cavitation pit reconstructed from 25 successive FIB slices 0.25 μm thick.

FIGS. 6*a-e* show the results of E-waste upcycling of cellular subscriber identity module (SIM) cards using the ultrasonication method. FIG. 6*a* shows a focused ion beam milling (FIB) experiment, revealing that the surface of the SIM card (inset) consisted of a thin Au layer supported on a Ni substrate. FIG. 6*b* is a UV-vis spectrum of the resulting solution after ultrasonication of a SIM card in a mixture of water, DDAB, and dodecanethiol. The inset shows the lightly colored pink reaction solution and visible surface degradation of the SIM card following ultrasonication. FIG. 6*c* is a TEM of a 10 nm nanoparticle indexed to fcc gold viewed down the <111> zone axis. FIG. 6*d* is a SAED pattern of nanostructures liberated from the surface of a SIM card indexed to fcc gold. FIG. 6*e* is an EDX measurements showing that Au was the only metal present in solution (Cu signal is due to the TEM grid).

DETAILED DESCRIPTION OF THE INVENTION

Figure 1:
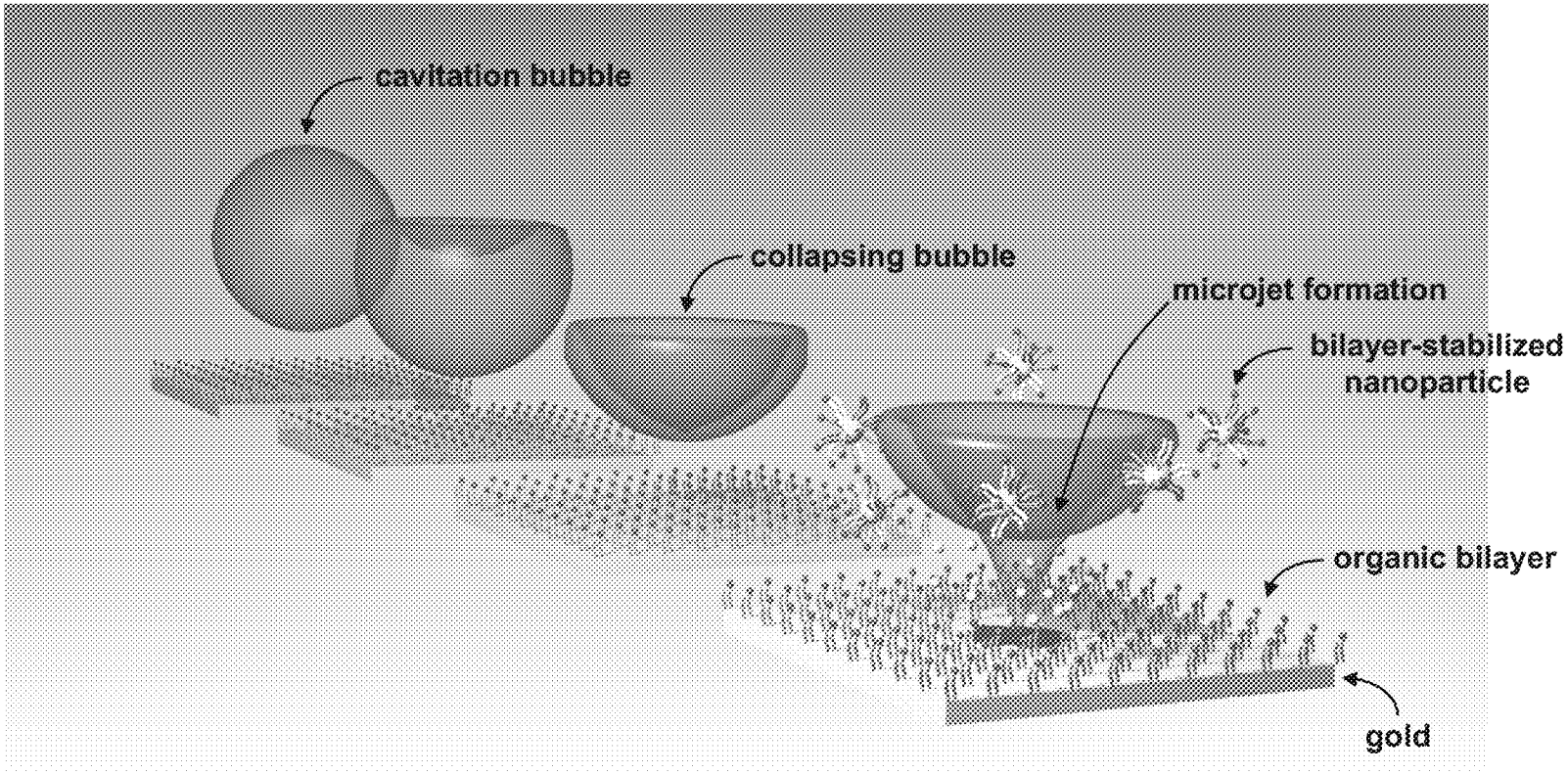
FIG. 1 is a schematic representation of cavitation bubble collapse leading to pit formation and material ejection.

According to the present invention, gold nanoparticles can be produced in significant quantities directly from either bulk or larger particulate materials under a range of conditions. The mechanism does not involve a continuous decrease in size, but jumps directly from micron or larger size to the nanoscale. The process likely involves a microjet forming near the surface that ablates material from the surface, some of which forms nanoparticles. By providing an appropriate surfactant in the immediate vicinity of the ablation, the nanoparticles can be protected from agglomeration and collected.

The green chemistry approach of the present invention forms gold nanoparticles directly from bulk metallic gold using ultrasonication, bypassing the toxic dissolution and reduction steps outlined above. Ultrasound spans frequencies from 20 kHz to 10 MHz and when applied to a liquid medium drives the nucleation, growth and implosive collapse of cavitation bubbles. See K. S. Suslick and D. J. Flannigan, *Annu. Rev. Phys. Chem.* 59, 659 (2008); and K. S. Suslick and G. J. Price, *Annu. Rev. Mater. Sci.* 29, 295 (1999). These bubble collapse events yield extremely high local temperatures (>5000 K) and pressures (>20 MPa), along with free-radical species, which can be used to drive chemical transformations. This phenomenon has previously been used to form nanoparticles from metal salt solutions; yet there are only a few examples of direct formation from bulk sources. See H. Xu et al., *Chem. Soc. Rev.* 42, 2555 (2013); and A. Gedanken, *Ultrason. Sonochem.* 11, 47 (2004). Li et al. used ultrasonic cavitation to produce tin nanoparticles from tin granules, and micro- and nanoparticles have been formed from low melting point metals and their alloys. See Z. Li et al., *Ultrason. Sonochem.* 14, 89 (2007); H. Friedman et al., *Ultrason. Sonochem.* 20, 432 (2013); and Z. H. Han et al., *Ultrasonics* 51, 485 (2011). However, these methods required the bulk metal to first be molten and hence high boiling point solvents and a massive input of heat were needed; an impractical and not particularly green solution for the formation of gold nanoparticles.

The method of the present invention occurs simply in water, by the ultrasonication of bulk gold sources in the presence of an alkylthiol species (dodecanethiol) and a surfactant (didodecyldimethylammonium bromide, DDAB). The production of nanoparticles begins with the formation of a dodecanethiol/DDAB organic bilayer on the surface of bulk gold. This is followed by the collapse of cavitation bubbles, which impinge violently on the surface, ejecting nanostructured material that becomes stabilized in solution by the organic bilayer. The nanostructures can be easily isolated and digestively ripened in water to yield a gold nanoparticle solution with a well-defined SPR. A number of different forms of bulk gold can be subjected to ultrasonication according to this method. Finally, the method can be applied to an important environmental problem; the recovery of gold from electronic waste streams. For example, using ultrasonication, gold nanostructures can be extracted directly from the surface of cellular subscriber identity module (SIM) cards, with no prior manipulation of the SIM cards required. This method provides an improvement on current extraction techniques by upcycling gold from an electronic waste stream directly to a high value product, without the need for harsh solvents or reducing agents.

Mechanism of Nanoparticle Formation

FIG. 1 shows a schematic representation of cavitation bubble collapse leading to pit formation and material ejection. When bulk gold is subjected to ultrasonication in the presence of dodecanethiol, didodecylammonium bromide (DDAB), and water, a dodecanethiol/DDAB organic bilayer is observed to form on the surface. Here, the schematic shows the ejection of material as nanoparticles, which are stabilized in solution by the dodecanethiol/DDAB bilayer.

According to the invention, under specific reaction conditions cavitation bubble collapse events can provide the driving force for the formation of gold nanostructures directly from bulk sources. As shown in FIG. 1, if the surface at the liquid-solid interface is significantly larger than the cavitation bubble, uniform bubble collapse no longer occurs. See K. S. Suslick and G. J. Price, *Annu. Rev. Mater. Sci.* 29, 295 (1999). Instead there is an asymmetric collapse which generates a micro-jet of liquid to the surface. The tip velocities of these micro-jets can reach 100 $ms^{-1}$ and by impinging on a surface can cause powerful shockwaves, material ejection, pitting and cavitation erosion in brittle materials. See K. S. Suslick and G. J. Price, *Annu. Rev. Mater. Sci.* 29, 295 (1999); and E. Maisonhaute et al., *Ultrason. Sonochem.* 9, 297 (2002). This phenomenon is well-known and is commonly associated with the degradation of metal marine propellers. See F. Pereira et al., *Journal of Fluids Engineering-Transactions of the Asme* 126, 671

(2004). Scientifically, the cavitation erosion of aluminum foil is often used to characterize an ultrasonic field in aqueous conditions. See B. Pugin, *Ultrasonics* 25, 49 (1987); M. Manikandan et al., *RSC Advances* 6, 32405 (2016); and B. Verhaagen and D. F. Rivas, *Ultrason. Sonochem.* 29, 619 (2016). Here, a brittle aluminum oxide layer forms which is subsequently removed by deformation of the surface, eventually leading to the complete dissolution of the metal. See T. J. Mason and D. Peters, *Practical Sonochemistry,* 2nd Edition ed.; Woodhead Publishing (2002).

Liberated material is expected to be diverse in size and shape as the size distribution of bubbles induced by the ultrasonic field is relatively large. See A. Brotchie et al., *Phys. Rev. Lett.* 102, 084302 (2009). Furthermore, in a high energy environment such as an ultrasonic field the fate of the material is uncertain. Degradation of large solid particles due to shear forces induced by microstreaming and shock waves can lead to a reduction in particle size and an increase in surface area. See T. J. Mason and D. Peters, *Practical Sonochemistry,* 2nd Edition ed.; Woodhead Publishing (2002). On the other hand, shockwaves can drive metal particles together at extremely high speeds, leading to interparticle fusion and an increase in particle size. See S. Doktycz and K. Suslick, *Science* 247, 1067 (1990); D. Radziuk et al., *Journal of Physical Chemistry C* 114, 1835 (2010); and T. Prozorov et al., *J. Am. Chem. Soc.* 126, 13890 (2004). This mechanism for particle fusion occurs over a narrow critical size range. Larger particles experience stronger viscous drag reducing the forces of impact; whereas smaller particles have less cross-sectional surface area for the shockwaves to act upon, reducing their velocity in solution. See T. Prozorov et al., *J. Am. Chem. Soc.* 126, 13890 (2004). These particles possess insufficient kinetic energy for particle fusion and will experience elastic collisions upon impact. Within the narrow size range, particles will experience a sufficient driving force such that a critical velocity is reached and coalescence occurs upon impact. Therefore, in terms of nanoparticle formation successively reducing particle size by cavitation erosion would not be a suitable approach, as a lower limit would eventually be reached leading to particle fusion. For example, Kass used water as a solvent to reduce the size of alumina particles to 1 μm using ultrasonication fragmentation. Upon analysis with SEM it was found that they were agglomerates of particles around 100 nm in diameter. See M. D. Kass, *Mater. Lett.* 42, 246 (2000).

Therefore, forming gold nanoparticles directly from bulk metals using ultrasonication presents a number of unique challenges. Nanoparticles would need to be formed directly below the particle fusion threshold and stabilized in solution to prevent coalescence. Furthermore, the current understanding of cavitation erosion cannot be readily applied to gold. Gold is an incredibly ductile and malleable metal that is resistant to oxidation and ejection of material typically requires high energy ablation methods employing focused ion or laser beams. See H. Wender et al., *Nanoscale* 3, 1240 (2011); and J. P. Sylvestre et al., *J. Phys. Chem. B* 108, 16864 (2004). However, according to the present invention, simple organic additives can lead to the formation of nanostructures from bulk gold under ultrasonication. First, the surface of the bulk gold is modified by a self-assembled monolayer (SAM) of dodecanethiol, a process that is promoted by ultrasonication. See H. Dai et al., *Electrochim. Acta* 53, 3479 (2008). Dodecanethiol SAMs form on gold surfaces initially through physisorption followed by chemisorption, yielding a covalent Au—S interaction. See C. Vericat et al., *Chem. Soc. Rev.* 39, 1805 (2010). Then, with DDAB present in solution a surface organic bilayer is expected to form. Liberated material takes the form of nanostructures which are stabilized in solution due to the charged amine functionality of DDAB. See S. E. Lohse and C. J. Murphy, *Chem. Mater.* 25, 1250 (2013).

Nanoparticle Synthesis Directly from Bulk Sources

FIG. 2*a* shows the results from the ultrasonication of a bulk gold powder in the presence of DDAB and dodecanethiol, in water. As shown in FIG. 2*b*, scanning electron microscopy (SEM) analysis revealed the powder consisted of hexagonal and plate-like particles 1.68±0.93 μm in size. FIG. 2*c* shows the ultrasonication reaction setup which consists of a glass cooling jacket and conical shaped reaction vessel. The cooling jacket was kept at 0° C. as the energy of bubble collapse is known to increase with decreasing temperature. See T. J. Mason and D. Peters, *Practical Sonochemistry,* 2nd Edition ed.; Woodhead Publishing (2002). The titanium ultrasonic horn had a 6.4 mm diameter tip and was placed into the reaction mixture ensuring no contact with the surrounding glass vessel. In a typical experiment 100 mg (0.5 m mol) of a source of bulk gold was added to 15 mL DI $H_2O$ along with 125 mg (0.27 m mol) didodecyldimethylammounium bromide (DDAB) and 75 mg (0.37 m mol) dodecanethiol in the conical shaped glass sonication vessel cooled to 0° C. Ultrasonication was performed at 18 W with a frequency of 20 kHz for up to 6 h. As shown in FIG. 2*d*, the resulting solution possessed a dark blue color, characteristic of finely divided gold. As shown in FIG. 2*e*, UV-vis analysis showed a broad absorption starting at ~500 nm and stretching into the near-infrared (NIR). Also present in the spectra is a broad absorption stretching below ~500 nm into the UV, caused by scattering from excess DDAB micelles. When the differential absorption is plotted (inset) two distinct absorption peaks are observed, located at 389 nm and 451 nm.

Figure 3A:
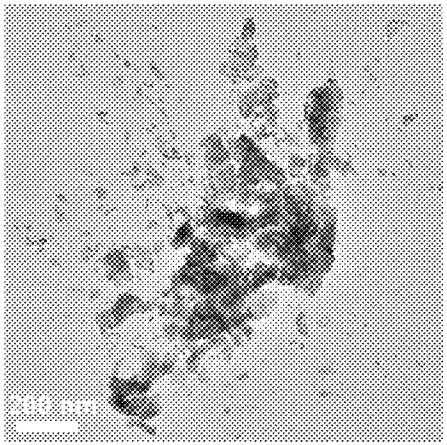
FIGS. 3*a-f* show the results of transmission electron microscopy (TEM) experiments on the as-sonicated gold nanostructures.
Figure 3B:
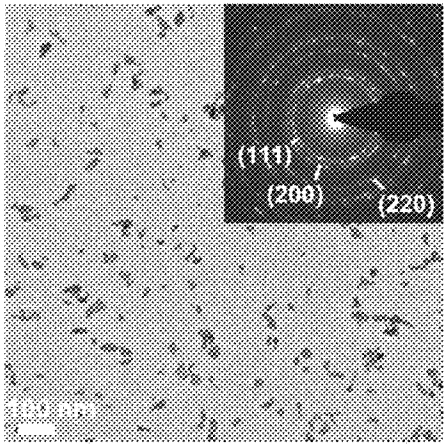
Figure 3C:
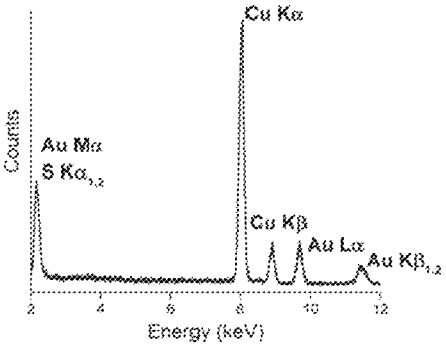
Figure 3D:
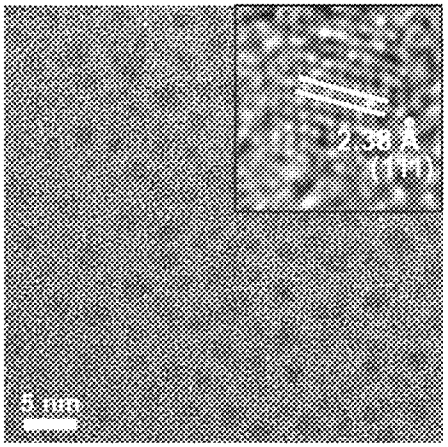
Figure 3E:
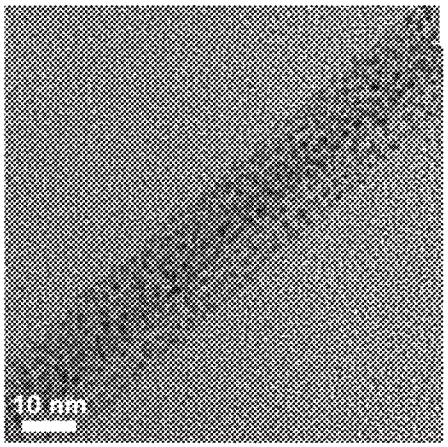
Figure 3F:
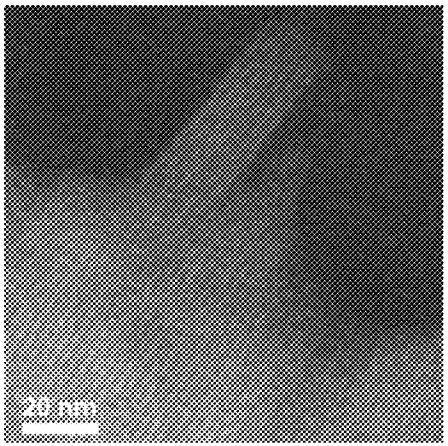

Transmission electron microscopy (TEM) experiments were performed on the as-sonicated reaction product. As shown in FIG. 3*a*, at low magnification relatively large sub-micron sized structures with ill-defined morphologies were observed. As shown in FIG. 3*b*, as the magnification was increased, gold spheroid and rod-like nanoparticles ranging in size from around 5 nm to 100 nm were identified. Selected area electron diffraction (SAED) of the nanoparticles could be indexed to the face centered cubic (fcc) crystal structure, characteristic of gold (FIG. 3*b*, inset). As shown in FIG. 3*c*, energy dispersive X-ray spectroscopy (EDX) experiments were also performed to ensure degradation of the titanium sonication horn did not result in contamination. The spectrum showed that gold was the only metal present in solution, with the copper background signal coming from the TEM grid. Gold nanostructures above ~2 nm in size display a SPR that red-shifts with increasing particle diameter. See U. Kreibig and L. Genzel, *Surf. Sci.* 156, Part 2, 678 (1985). Therefore the population of nanoparticles 5-100 nm size from FIG. 3*b* contributes to the broad absorption stretching into the NIR, as seen in FIG. 2*e*. As shown in FIG. 3*d*, at high magnification small, spherical nanoparticles 2.0±0.3 nm in size were observed. High resolution TEM (inset) showed visible lattice planes which could be indexed to the (111) plane of fcc Au. TEM and scanning transmission electron microscopy (STEM) experiments, shown in FIGS. 3*e* and 3*f*, revealed the small nanoparticles could form ribbon-like superstructures; which have previously been observed for small dodecanethiol coated nanoparticles. See Z. Wu et al., *ACS Nano* 9, 6315 (2015); and Z. Wu et al., *Angewandte Chemie-International Edition* 53, 12196 (2014). Nanoparticles of this size typically do not possess a SPR and optical absorption arises due to high energy molecular like transitions; observed here as absorption peaks at 389 nm and 451 nm, as shown in FIG. 2*e*. See M. M. Alvarez et al., *The Journal of Physical Chemistry B* 101, 3706 (1997); and T. G. Schaaff et al., *The Journal of Physical Chemistry B* 101, 7885 (1997).

In order to improve atom economy, the sub-micron sized particulate was recovered by centrifugation and added again to a mixture of dodecanethiol and DDAB in water. This was subjected to further ultrasonication and again led to the formation of nanostructured gold. By doing this, the bulk gold precursor could be continuously consumed, and could theoretically reach a quantitative yield.

The effect the organic additives had on the formation of the nanostructures was investigated. Firstly, ultrasonication was performed on gold powder with no alkylthiol or surfactant present i.e., in water only. No change in the color of the reaction solution was observed after 6 h ultrasonication time. This was confirmed by the lack of absorption peaks in the corresponding UV-vis spectra, indicating no nanostructures were formed. The same lack of absorbance was observed when either DDAB only or dodecanethiol only were added to the reaction mixture, indicating the presence of the organic bilayer is critical for the formation of nanostructures. To confirm the importance of bilayer formation dodecanethiol was substituted with either DL-dithiothreitol or 1,8-octanethiol. DL-dithiothreitol does not form well packed monolayers due to the presence of bulky hydroxyl groups and dithiols are known to be much more sensitive to formation conditions. See C. Vericat et al., *Chem. Soc. Rev.* 39, 1805 (2010). To confirm, ellipsometry experiments were performed on Si wafers sputtered with Au that had been subjected to ultrasonication for 20 min in model reaction solutions. Ellipsometry showed the gold surface sonicated with dodecanethiol had a thin film thickness of 1.62 nm, indicating a well-formed monolayer. See H. Dai et al., *Electrochim. Acta* 53, 3479 (2008) and J. C. Love et al., *Chem. Rev.* 105, 1103 (2005). Measurements on DL-dithiothreitol and 1,8-octanedithiol solutions showed thin film thicknesses of 0.40 nm and 0.08 nm, respectively, indicating either monolayers were not formed or the thiols were in the lying down phase. See C. Vericat et al., *Chem. Soc. Rev.* 39, 1805 (2010). When bulk gold was subjected to ultrasonication in the presence of these alkyl thiols and DDAB a dramatic decrease in the absorption intensity, and hence nanostructure yield, was observed. The quaternary ammonium surfactant species, along with counter-ion, were then changed and little effect on nanostructure formation was observed. Cetyltrimethylammonium bromide (CTAB) and cetyltrimethyl ammonium chloride (CTAC) gave similar absorption profiles to the reaction with DDAB. This indicates the quaternary ammonium surfactants role is limited to bilayer formation; varying the type of surfactant does not directly affect the nature of the gold surface.

Figure 4A:
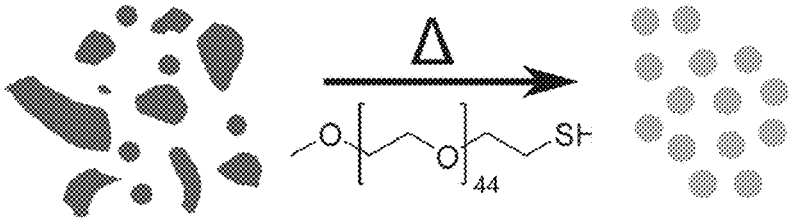
FIG. 4*a* is a schematic representation of digestive ripening the as-sonicated gold nanostructures with poly(ethylene glycol) methyl ether thiol (PEG-2000-SH) in water.
Figure 4B:
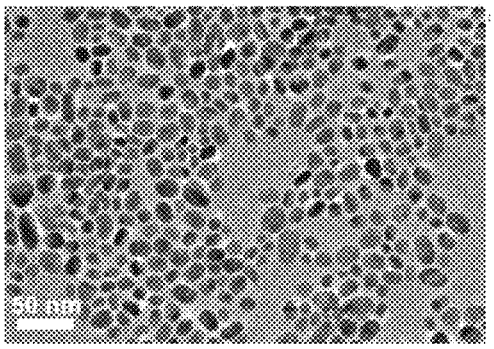
FIG. 4*b* is a TEM of the as-ripened gold nanoparticles.
Figure 4C:
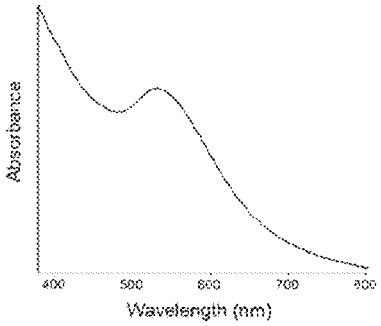
FIG. 4*c* is a UV-vis spectrum showing a defined SPR centered at $\lambda_{max}$=530 nm. Different bulk sources of gold were then selected to undergo ultrasonication and digestive ripening.
Figure 4D:
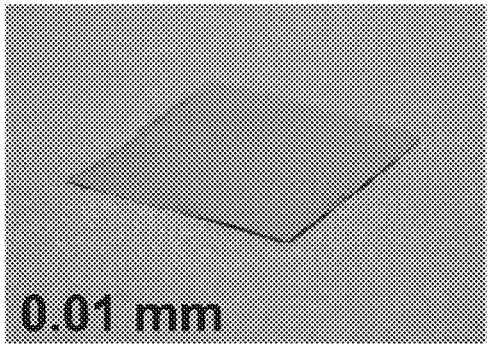
FIG. 4*d* shows a section of gold foil 0.01 mm thick.

For effective application of gold nanoparticles, a well-defined SPR is typically desired. To achieve this, a simple non-toxic digestive ripening step was employed that does not require harmful organic solvents, as shown schematically in FIG. 4*a*. See A. Silvestri et al., *J. Colloid Interface Sci.* 439, 28 (2015); and B. L. V. Prasad et al., *Langmuir* 18, 7515 (2002). An aliquot of the blue solution shown in FIG. 2*d* was taken and refluxed in water in the presence of a relatively benign ripening agent; poly(ethylene glycol) methyl ether thiol (PEG-2000-SH). After digestive ripening a size selection step was performed by centrifugation. As shown in FIG. 4*b*, TEM analysis showed that the resulting nanoparticles were spherical in shape and 12.7±3.1 nm in size, indicating the dissolution of the small (~2 nm) nanoparticles. As shown in FIG. 4*c*, UV-vis analysis showed a well-defined SPR centered at $\lambda_{max}$=530 nm. Due to its large molecular weight PEG-2000-SH could be easily recovered by rotary evaporation and recycled, further increasing atom economy.

Figure 4E:
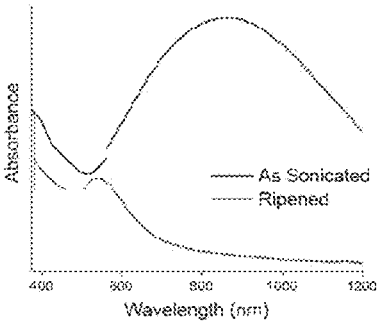
FIG. 4*e* is a UV-vis spectrum showing that the resulting nanoparticles displayed a SPR at $\lambda_{max}$=536 nm.
Figure 4F:
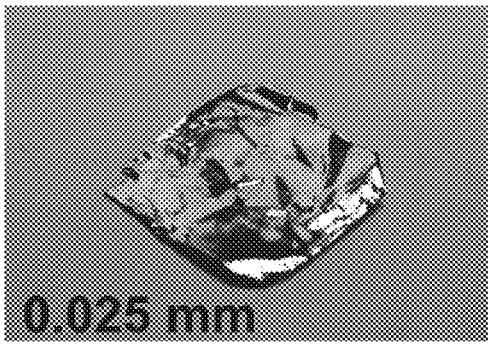
FIG. 4*f* shows a 0.025 mm thick foil.
Figure 4G:
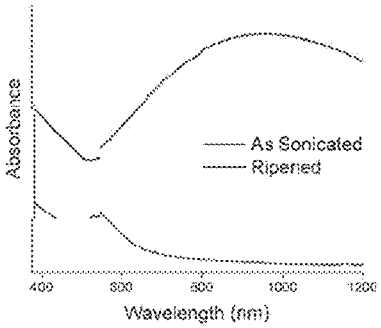
FIG. 4*g* is a UV-vis spectrum showing that the resulting nanoparticles displayed a SPR at $\lambda_{max}$=534 nm (g).

To demonstrate the versatility of this method, it was applied to a number of different sources of bulk gold. FIG. 4*e* shows the results from the ultrasonication of a sample of gold foil 0.01 mm thick. The UV-vis spectra shown closely resemble the optical profile shown in FIG. 2*e*, indicating a similar size distribution of the as-liberated gold nanostructures. Upon digestive ripening with PEG-2000-SH and size selection a well-defined SPR was observed centered at $\lambda_{max}$=536 nm. TEM analysis showed that the nanoparticles were spherical in shape and 14.2±4.1 nm in size. As shown in FIG. 4*g*, a similar result was observed upon ultrasonication of a sample of gold foil 0.025 mm thick. Here, following the digestive ripening and size selection steps, the broad absorptions stretching into the UV and NIR were replaced with a SPR centered at $\lambda_{max}$=534 nm. The nanoparticles produced from 0.025 mm gold foil were 12.2±2.8 nm in size. UV-vis absorption intensity, and hence nanoparticle yield, was observed to decrease as foil thickness increased. A second form of gold powder was also subjected to ultrasonication. SEM analysis revealed it to consist of spherical grains 1.13±0.55 μm in size, with a roughened surface. Gold nanostructures were also formed, confirming the versatility of the ultrasonication method; however, yield was significantly reduced.

Surface Analysis

The effect that ultrasonication had on the different gold surfaces was then investigated by performing time-dependent SEM experiments. Microscopy was performed on samples that had undergone ultrasonication for 0 h (i.e., an unsonicated surface), 20 min, 2 h, 4 h, and 6 h. The degradation of the powder source used in FIG. 2*a* was so vigorous that information on the effect of ultrasonication was difficult to extract. However, the large planar surface of the 0.01 mm thick gold foil was well suited to give insight. SEM images taken at low and high magnifications are shown in FIGS. 5*a* and 5*b*, respectively. At 0 h, an essentially smooth and undisturbed surface was observed. At 20 min, a reduction in size and some reorganization, or curling, of the foil edges was observed; presumably due to melting and minimization of free surface energy. As shown in FIG. 5*b*, isolated spots of contrast difference on the foil surface was also observed, which can be attributed to the formation of cavitation pits caused by bubble collapse events. See M. Dular et al., *Ultrason. Sonochem.* 20, 1113 (2013). At 2 h, a further reduction in total particle size and a tear propagating towards the center of a piece of foil was observed. At 4 h, the number and size of the cavitation pits has significantly increased, with a certain number having coalesced. Large holes at the center of the foil pieces was also observed, indicating the foil had been punctured. See M. Dular et al., *Ultrason. Sonochem.* 20, 1113 (2013). Finally, at 6 h, only small particulate and the disappearance of larger foil pieces was observed, indicating consumption of the bulk gold source. Analysis of the 0.025 mm thick foil showed similar effects however the degree of pitting and tearing was noticeably less extensive at each time point.

In order to fully characterize a single cavitation pit a combination of high magnification SEM and focused ion beam (FIB) milling were used. As shown in FIG. 5*c*, the cavitation pit possesses an irregular shape, which would suggest that successive bubble collapse events had occurred once the pit had initially formed, as has previously been observed for pit formation on aluminum surfaces. See M. Dular et al., *Ultrason. Sonochem.* 20, 1113 (2013). To map the lower surface of the cavitation pit it was first filled with Pt using ion beam induced platinum deposition; then 25 successive 0.25 μm thick slices were milled using a $Ga^+$ ion beam. These were individually imaged using SEM, with a single slice shown in FIG. 5*d*. The images were compiled to give an animation of the surface profile. The FIB slices were also reconstructed into a 3D schematic, shown in FIG. 5*e*. The image shows the pit is up to 1.7 μm deep, up to 5 μm in length and up to 3 μm wide. The surface is non-uniform and possesses a roughness exceeding 0.5 μm in places, which supports the suggestion that this cavitation pit was formed from multiple bubble collapse events.

SEM was then used to investigate the surface of the bulk gold source which had been subjected to ultrasonication for 6 h with no organic additives i.e., in water only. Visible surface rearrangement characteristic of melting was present; however, the average macroscopic particle size was unchanged. In comparison, when additives are present, the average particle size reduces significantly with ultrasonication time. This indicates that the gold sources are experiencing a similar environment within the ultrasonic field yet only when organic additives are present is material liberated from the surface.

The above results indicate that the dodecanethiol/DDAB bilayer renders the surface of bulk gold susceptible to degradation from collapsing cavitation bubbles. The organic bilayer introduces a tensile stress to the surface, which reduces the energy barrier to material ejection. The strength of this effect is reduced when bilayer formation is less complete i.e., when DL-dithiothreitol or octanedithiol are used. The role of DDAB is limited to its behavior as a surfactant; in bilayer formation on the gold surface, stabilizing the liberated nanostructures and transporting dodecanethiol to the gold surface in the early stages of the reaction. When no organic additives are present, localized surface rearrangement due to melting is observed; however, no nanostructure formation or bulk material loss is observed.

The hypothesis that nanostructure formation occurs due to cavitation erosion and material ejection is supported by the observation that an increase in surface area of the bulk gold source leads to an increase in nanostructure yield. A larger surface area is able to accommodate a larger number of cavitation events. The exception to this is the gold powder that possesses a spherical morphology and high surface area yet gave a relatively low nanostructure yield. In this case, the curved surface dissipates the energy of the collapsing bubble, reducing the force of any potential impact. See T. J. Mason and D. Peters, *Practical Sonochemistry,* 2nd Edition ed.; Woodhead Publishing (2002); and E. A. Neppiras, *Physics Reports-Review Section of Physics Letters* 61, 159 (1980). On the other hand, the planar surfaces of the foils and hexagonal and plate-like powder are well-suited to experience the full force of micro-jet impact, and a good yield of gold nanostructures is formed. The increase in nanostructure yield with decreasing foil thickness can be explained by the tearing, ripping, or puncturing of the foil. Such imperfections are more readily formed in thinner foil which then act as cavitation generation sites; triggering more cavitation activity leading to greater mass loss. See M. Dular et al., *Ultrason. Sonochem.* 20, 1113 (2013). Interestingly, although the absorption intensity varied significantly between bulk gold sources the shape of the absorption profile did not. This would indicate that the nature of the liberated material is more strongly dictated by the bubble collapse event itself than the overall morphology of the bulk gold source.

TEM analysis revealed the ejected material to consist of relatively large sub-micron particles, rod-like and spheroid nanoparticles 5-100 nm in size, and small ~2 nm nanoparticles. This large size distribution is expected, due to the large distribution of bubble sizes formed in water upon the application an ultrasonic field. See A. Brotchie et al., *Phys. Rev. Lett.* 102, 084302 (2009). The critical velocity for melting upon particle impact was calculated to be 628 $ms^{-1}$ for Au. See T. Prozorov et al., *J. Am. Chem. Soc.* 126, 13890 (2004). This indicates that the critical size range for particle fusion is between 3.3 μm and 20 μm. The gold powder in FIG. 2*a* possesses a size of 1.68±0.93 μm which is well below the particle fusion threshold. This confirms that nanoparticle formation does occur from successive size reduction and that all nanostructures formed from the gold powder are produced by cavitation bubble collapse and material ejection. For the gold foil samples, clearly this begins well above the particle fusion threshold of 20 μm. The presence of cavitation pits shows that material ejection is occurring leading to nanoparticle formation and material loss. Therefore, some particle fusion is expected once the size of the foil particles had been reduced to <20 μm. This was not observed, however the probability of particle impact in such a dilute solution is very low. Radziuk et al suggested that nanoparticle coalescence could occur below the particle fusion threshold as the colloidal solution could be nebulized into the hot domain of the pulsating bubble, leading to localized melting. See D. Radziuk et al., *Journal of Physical Chemistry C* 114, 1835 (2010). The behavior was less significant when long chain organic surfactants were employed as surface stabilizers. Here, the lack of particle coalescence indicates that the dodecanethiol/DDAB bilayer is an effective barrier to this mechanism.

The relatively tight size distribution of the nanoparticles ~2 nm in size would indicate that simple material ejection cannot explain their formation. These nanoparticles most likely form in a manner analogous to laser ablation, where cavitation collapse is accompanied by atomization; followed by the growth of nanoparticles from the 'bottom-up'. See V. Amendola and M. Meneghetti, *PCCP* 15, 3027 (2013). The observation of agglomerations of small gold nanoparticles supports the idea that these nanoparticles are growing from free monomer in solution, as this type of behavior has previously been seen in nanoparticles grown from $HAuCl_4$ under an ultrasonic field. See Z. Zhong et al., *J. Mater. Chem.* 16, 489 (2006).

Application to E-waste Upcycling

The results above indicate that the ultrasonication method is applicable to a wide range of bulk gold metal sources, as long as there is a suitable surface to induce asymmetric cavitation bubble collapse. Therefore, the method can be applied to liberate gold nanoparticles from an environmentally important electronic waste stream; cellular subscriber identity module (SIM) cards. Electronic waste can contain significantly more Au content when compared to traditional ores and is set to become an important metal source as consumption continues to rise. See Y. He and Z. Xu, *Rsc Advances* 5, 8957 (2015). Recovery and recycling are energy intensive and typically require the removal of any non-metal supports followed by dissolution in cyanide or aqua regia. See J. Cui and L. Zhang, *J. Hazard. Mater.* 158, 228 (2008). The ultrasonication method of the present invention is well-suited for SIM cards as they possess a large planar surface of exposed gold in the form of the electrical contact. The composition of a typical SIM card was first investigated using FIB milling, as shown in FIG. 6*a*. A layer of platinum was deposited to protect the gold and the surface was etched with $Ga^+$ ions to a depth of 2 μm. EDX spectroscopy revealed that the surface of the SIM card consisted of a uniform layer of gold 170 nm thick, in contact with a Ni underlayer. Therefore, a typical SIM card has the potential to yield approximately 0.75 mg of liberated Au, depending on the exact form factor.

An unaltered SIM card complete with plastic support, as shown in FIG. 6*a*, was placed in the sonication vessel along with DDAB and dodecanethiol, and sonicated for 6 h. As shown in FIG. 6*b*, following ultrasonication the gold contacts of the SIM card were visibly degraded and a lightly pink colored solution resulted, characteristic of nanostructured gold. SEM analysis revealed an eroded surface and the presence of cavitation pits. As the Au is in close proximity to Ni there was a high probability that some Ni is also liberated. Therefore, the as-sonicated reaction solution was placed in a magnetic field to remove any unwanted Ni-based side-products. Indeed, the separated magnetic pellet contained Ni nanoparticles with a wide distribution of sizes.

To isolate the Au nanoparticles from any additional impurities, a room-temperature gold selective thiol-mediated organic phase transfer was performed. The UV-vis spectrum of the resulting solution is shown in FIG. 6*b*. Present are two absorbance maxima at 336 nm and 416 nm indicative of the presence of small nanoparticles displaying molecular like transitions. The peaks were blue shifted when compared to the hexagonal and plate-like powder experiments indicating a smaller nanoparticle size. See U. Kreibig and L. Genzel, *Surf. Sci.* 156, Part 2, 678 (1985); and J. D. Ganiére et al., *Solid State Commun.* 16, 113 (1975). Also present is a SPR centered at 532 nm; however, the broad absorption stretching into the NIR seen in FIG. 2*e* is absent. TEM analysis revealed crystalline nanostructures with ill-defined shapes up to ~100 nm in size, as well as a population of smaller nanoparticles. As shown in FIG. 6*c*, a high magnification image of a gold nanoparticle 10 nm in size could be indexed to the fcc crystal structure view down the <111> zone axis. As shown in FIG. 6*d*, a SAED pattern could be indexed to the fcc crystal structure, characteristic of gold. As shown in FIG. 6*e*, EDX analysis showed that gold was the only metal present in solution, with the Cu signal originating from the TEM grid.

The present invention has been described as a method for the direct formation of gold nanoparticles using ultrasound. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A method of forming gold nanoparticles, comprising providing a solid bulk gold in an aqueous solution comprising an alkylthiol and a surfactant that form an organic bilayer on a surface of the solid bulk gold; and ultrasonicating the aqueous solution to form gold nanoparticles by implosive collapse of cavitation bubbles on the surface of the solid bulk gold.

2. The method of claim 1, wherein the alkylthiol comprises dodecanethiol.

3. The method of claim 1, wherein the surfactant comprises a quaternary ammonium salt.

4. The method of claim 3, wherein the quaternary ammonium salt comprises didodecyldimethylammonium bromide.

5. The method of claim 3, wherein the quaternary ammonium salt comprises cetyltrimethylammonium bromide or cetyltrimethylammonium chloride.

6. The method of claim 1, wherein the ultrasonicating uses an ultrasound frequency between 20 kHz and 10 MHz.

7. The method of claim 1, wherein the gold nanoparticles are less than 100 nm in size.

8. The method of claim 1, further comprising digestive ripening of the gold nanoparticles.

9. The method of claim 8, wherein the digestive ripening comprises refluxing in water in the presence of a ripening agent.

10. The method of claim 9, wherein the ripening agent comprises poly(ethylene glycol) methyl ether thiol.

11. The method of claim 1, wherein the solid bulk gold comprises a metallic gold powder.

12. The method of claim 11, wherein the size of the metallic gold powder is less than 20 μm.

13. The method of claim 1, wherein the solid bulk gold comprises a gold contact.

14. The method of claim 13, wherein the gold contact comprises an electronic waste.

15. The method of claim 14, wherein the electronic waste comprises a cellular subscriber identity module card.

* * * * *